United States Patent [19]

Wildt

[11] Patent Number: 4,709,813

[45] Date of Patent: Dec. 1, 1987

[54] ANTI-THEFT DEVICE FOR COMPACT DISCS

[75] Inventor: Theodor N. Wildt, St. Paul, Minn.

[73] Assignee: Minnesota Mining and Manufacturing Company, St. Paul, Minn.

[21] Appl. No.: 850,161

[22] Filed: Apr. 10, 1986

[51] Int. Cl.[4] ..... B65D 85/57

[52] U.S. Cl. ..... 206/312; 206/310; 206/444; 206/1.5; 206/807

[58] Field of Search ..... 206/309, 312, 310, 493, 206/807, 480, 482, 1.5, 444; 292/279, 280; 360/131, 133, 135

[56] References Cited

U.S. PATENT DOCUMENTS

| | | | |
|---|---|---|---|
| 2,202,925 | 6/1940 | Schoch | 292/307 R |
| 2,607,618 | 8/1952 | Ernest | 292/280 |
| 2,621,064 | 12/1952 | Ware | 292/302 |
| 4,075,618 | 2/1978 | Montean | 324/262 |
| 4,425,999 | 1/1984 | MacDonald et al. | 206/444 |
| 4,499,994 | 2/1984 | Rentch | 206/575 |

FOREIGN PATENT DOCUMENTS

| | | | |
|---|---|---|---|
| 179970 | 10/1983 | Japan | 206/387 |

*Primary Examiner*—Stephen Marcus
*Assistant Examiner*—Brenda J. Ehrhardt
*Attorney, Agent, or Firm*—Donald M. Sell; James A. Smith; William B. Barte

[57] ABSTRACT

An anti-theft device for restricting unauthorized removal of an article such as a CD audio disc from a cartridge having a mounting stud resiliently engaging a central opening in the article when it is positioned in the cartridge. The device includes a locking plate, a lock spring and a lock gear for locking the article between the plate and cartridge. The locking plate has a plurality of holes therethrough arranged in a pre-selected pattern, and a release tool having a similarly disposed plurality of pins which when inserted through the holes actuates the lock spring allowing the plate to be removed and the article taken from the cartridge.

16 Claims, 3 Drawing Figures

ANTI-THEFT DEVICE FOR COMPACT DISCS

FIELD OF THE INVENTION

The invention relates to a device for securing articles, particularly compact digital (CD) audio discs, to restrict unauthorized removal of such articles from an enclosure or cartridge, and further to protect such articles against pilferage.

BACKGROUND OF THE INVENTION

The recording medium conventionally referred to as a compact digital (CD) audio disc is gaining acceptance. However, because of its comparatively small size, it is easily stolen. Such articles, and others similar in size and shape, are known to have been protected by a variety of methods including locked, but transparent, display cases sometimes having small access holes allowing shoppers to handle the articles without removing them from the cases. Other known techniques include securing the article onto a bulky cardboard backing, making the packaged article too large to be readily concealed.

SUMMARY OF THE PRESENT INVENTION

The present invention addresses problems attendant to such prior techniques by providing an anti-theft device for restricting unauthorized removal of an article, such as a recording medium, a compact recording medium, digital audio disc, or the, like from a cartridge adapted to be sold with the article and to be subsequently used for storage of that article. In the device, the cartridge is provided with a mounting stud engaging a central opening in the article to be protected when the article is in position in the cartridge. The device further includes a perforate plate and means for locking the plate to the mounting stud of the cartridge when the article is in position between the perforate plate and the cartridge. The locking means is releaseable by unlocking means having thereon pins to engage through-holes in the perforate plate from the side thereof opposite the disc, thereby actuating the locking means for releasing the plate and disc from the mounting stud.

The device of the present invention thus effectively and efficiently protects compact discs or similar articles against point of sale pilferage. The device is particularly desirable in that authorized sales personnel may assemble it with conventional compact discs and their cartridges in a most simple and rapid manner. Advantageously, it is not possible to remove the anti-theft device from a disc by simple manipulation once the device has been assembled with the compact disc, yet it may be removed by authorized sales personnel in a very simple manner. Another advantage is that the inventive anti-theft device is very simple in construction and thus may be fabricated at very low cost.

BRIEF DESCRIPTION OF THE DRAWINGS

In order that the invention may be better understood, various embodiments thereof will now be explained in detail under reference to the attached drawings.

DETAILED DESCRIPTION

The present invention is based on the following considerations. The theft of articles such as compact discs may be prevented by providing an anti-theft device constructed to lock the compact disc to an enclosure or cartridge, within which is also preferably included means to trigger the generation of a warning signal as the disc is moved through a monitoring zone. Also, the following conditions should be satisfied. It should be assured that the anti-theft device can be assembled with the compact disc and its cartridge by authorized personnel only, and the means for triggering the generation of a warning signal must itself be secured to the anti-theft device in a manner to be protected against external interference.

In its most general form, the anti-theft device comprises a flat perforate plate placed on the side of the disc which faces away from the cartridge, with the means for triggering the generation of an alarm signal being preferably attached to the side of the perforate plate which faces the compact disc. To safely prevent removal of the alarm signal triggering means, the perforate plate has an internal recess within which the triggering means, which may comprise a strip of magnetic material, may be placed. Such a means is thus spaced from the surface of the compact disc and out of reach of tools such as the blade of a knife.

It is desired for the anti-theft device to be lockable to the mounting stud of the cartridge in a manner such that the compact disc will be restrained between the perforate plate and the cartridge surface facing that plate. The lock is to be released only by authorized sales personnel by introducing in through-holes in the perforate plate from the side facing away from the compact disc the pins of a release tool which are disposed in a specific coded arrangement; the release mechanism is to be activated by such introduction.

Figure 1:
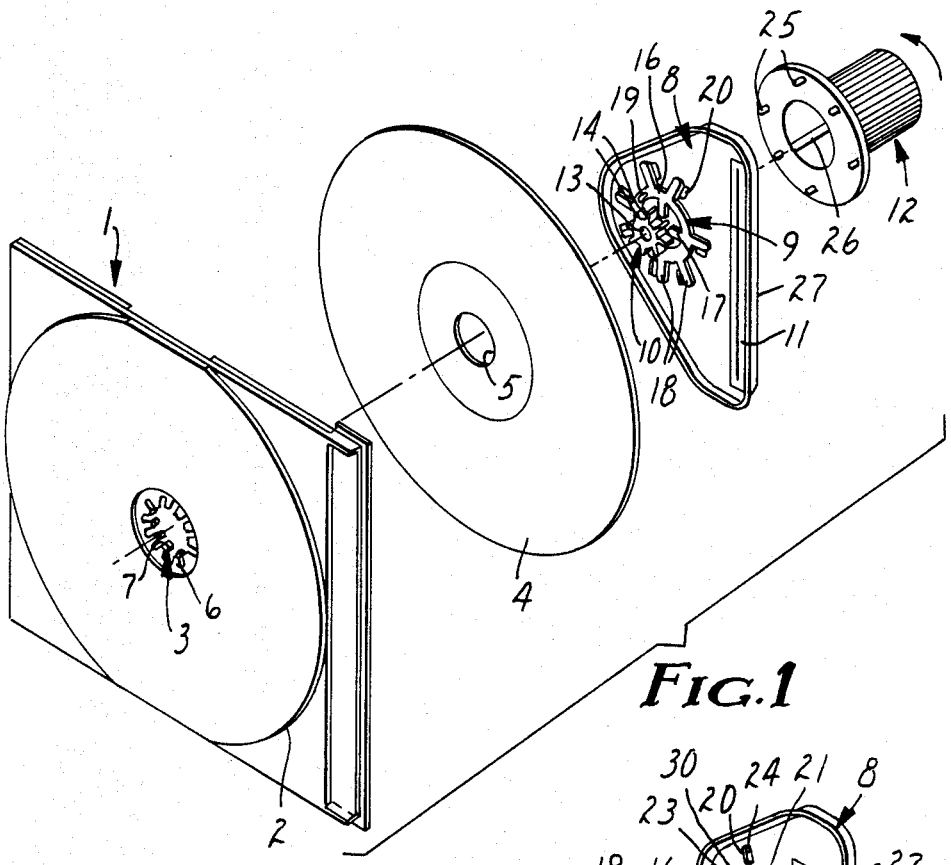
FIG. 1 shows a schematic view of a cartridge intended to receive a compact disc, a compact disc and the anti-theft device of the present invention prior to the assembly thereof with the compact disc and its cartridge.

FIG. 1 shows a conventional cartridge 1 (preferably made of a plastics material) for receiving a compact disc. As has been known, cartridge 1 has a mounting stud 3 disposed centrally in a recess 2. When placing a compact disc 4 into the recess 2 of the cartridge 1, a central opening 5 of the compact disc 4 is pushed over the stud 3 so that the stud 3 will project therethrough. Preferably, the receiving stud 3 comprises resilient stud fingers 6 uniformly spaced along its periphery, said fingers 6 initially extending from the recess 2 in the axis direction of the stud 3, and having radially inwardly projecting free ends. Gaps 7 are left between adjacent stud fingers 6 and their end portions. With the compact disc 4 placed in cartridge 1, the inwardly extending ends of stud fingers 6 project over the surface which faces away from recess 2 and lightly engage the central opening 5 to hold the disc 4 within the recess 2.

The inventive anti-theft device substantially comprises a perforate plate 8, a lock spring 9, a lock gear 10, and a release tool 12.

Preferably, an alarm triggering device 11 is also included. Such a device 11 preferably comprises at least one strip of high permeability, low coercive force magnetic material secured to the cartridge 1 in a manner such as to preclude removal by simple manipulation. Other known antipilferage devices such as tuned resonant inductive-capacitive circuits may also be used. A compact disc provided with a security strip 11 of this kind cannot be moved through a monitoring zone as may be provided short of the exit from a point of sale without triggering the generation of an alarm signal. Authorized personnel thus provide the compact discs with the inventive anti-theft devices containing the aforesaid security strips prior to placing them on sale, and remove the devices using the release tool 12 as the customers leave the point of sale premises through assigned exits where cash registers are set up. Those exits where no cash registers are set up are protected by the aforesaid monitoring zones, and if an anti-theft device including a sensitized security strip is still attached to the article, appropriate alarms, lockable gates, or the like will be actuated.

Figure 2:
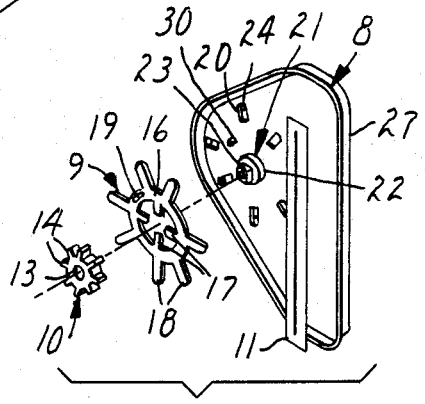
FIG. 2 is an exploded view of the inventive anti-theft device.
Figure 3:
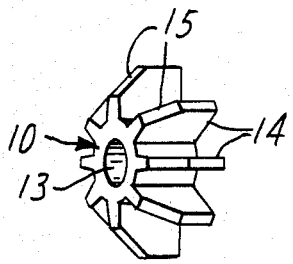
FIG. 3 shows a further embodiment of a portion of the inventive anti-theft device.

The detailed design of portions of the inventive anti-theft device will now be described under reference to FIG. 2. The aforesaid lock gear 10 has a central opening 13 and peripheral tooth-like projections 14 which are spaced and dimensioned to pass through gaps 7 in the mounting stud 3 on the cartridge 1 as the anti-theft device is placed thereon in an unlocked position. At that time, lock gear 10 is within the space enclosed by stud fingers 6 and their end portions. In order to facilitate the introduction of lock gear 10 into mounting stud 3, bevels 15 may be provided (FIG. 3) on the side of lock gear 10 which faces towards the compact disc. These bevels preferably are at 45° angles from a plane perpendicular to the axis of the lock gear 10 so that the gear tapers towards the side of the compact disc 4.

A lock spring 9 is provided between the lock gear 10 and the perforate plate 8, and essentially comprises a ring portion 16 which preferably is circular. From the ring portion 16, strip-shaped projections or tabs 17 extend radially inwardly, and additional strip-shaped projections or tabs 18 extend radially outwardly. Preferably, the ring portion 16 has therethrough an elongated slot 19, of which the function will be explained below. With the lock gear 10 secured to the perforate plate 8, the radially inwardly extending tabs 17 resiliently engage the surfaces of the lock gear 10 that face them. This way, the surfaces of the tabs 18 which face the perforate plate 8 are urged resiliently against the opposite surface of the perforate plate 8. This surface of the perforate plate 8 has therein elongated recesses 20 which receive the radially outwardly extending tabs 18 when the plate 8 has been turned into a predetermined locked position relative to the lock spring 9.

The lock gear 10 is secured such as by being welded or bonded, for example, to a stud 21 on the perforate plate 8 so that those members may be rotated as a single unit. Preferably, the stud 21 is shaped, as is evident in FIG. 2, to have a cylindrical boss 22 and a shaped projection 23 extending therefrom to engage a complementary opening in the lock gear 10. The shaped projection 23, which may be rectangular or triangular in shape, prevents the lock gear 10 from being rotated relative to the stud 21 and is aligned relative to the perforate plate 8 and lock spring 9. As the shaped projection 23 is smaller than the surface of the cylindrical boss 22 which faces away from the perforate plate 8, the surface of the lock gear 10 which faces the perforate plate 8 at least partially engages the surface of cylindrical boss 22 which faces towards the lock gear 10 so that the lock gear 10 is spaced from the perforate plate 8 by the cylindrical boss 22. The inner edges of the inwardly projecting strip-shaped tabs 17 of the lock spring 9 thus engage the peripheral surface of the cylindrical boss 22.

The aforesaid security strip 11, which may comprise at least one magnetic strip, but preferably comprises two such strips placed at right angles to each other, is attached—preferably bonded—to the inner surface of perforate plate 8 which faces lock gear 10, and is hidden from access by the flange 27 formed along the periphery of the plate.

As to their number and the angles between them, the outwardly extending strip-shaped tabs 18 of the lock spring 9 are non-uniformly distributed along the periphery of the ring portion 16 of the lock spring 9 in accordance with a pre-selected code. The same applies in analogy to the recesses 20 in the inner surface of the perforate plate 8. Each recess has therein a through-hole 24 through which a pin may be introduced from the side of the perforate plate 8 which faces away from the gear 10, so as to push the corresponding strip-shaped tab 18 from its recess 20 towards the lock gear 10.

Release tool 12 preferably is in the form of a knob having on a surface facing the outside of the perforate plate 8 pins 25 arranged in accordance with the aforesaid pre-selected code. By placing release tool 12 in a predetermined position in which each one of the pins 12 extends into a recess 20, all of the strip-shaped tabs 18 may be pushed from the associated recesses 20 towards the lock gear 10. Release tool 12 has a central pinion 26 adapted to be introduced into an opening provided in the cylindrical boss 22, and shaped projection 23 and, optionally, in the lock gear 10. Once the release tool 12 has thus been introduced, so that the pins 25 push all of tabs 18 from their recesses, the tool 12 and the plate 8 and gear 10 may be turned relative to the lock spring to the second or unlocked position. The teeth 14 of the gear may then be withdrawn through the gaps 7 in the mounting stud 3 of the cartridge and the plate 8 removed, allowing the disc 4 to also be removed.

For limiting rotation of the perforate plate 8 relative to the lock spring 9, a stop pin 30 provided on the inner surface of the perforate plate 8 engages the aforementioned elongated slot 19 in lock spring 9. Rotation of the plate 8 relative to the spring 9 in either direction is limited by the stop pin 30 engaging either end of elongated slot 19. This way, each tab 18 will engage its assigned recess 20 when the stop pin 30 engages one end of the slot, whereas, when the stop pin 30 engages the other end of the slot 19, the tabs 18 do not engage their assigned recesses and come to lie in a position at least partly laterally offset from their assigned recesses.

The operation of the inventive anti-theft device will now be explained in detail. Prior to attaching the anti-theft device, a compact disc 4 is placed inside a cartridge 1 in a manner such that the central opening 5 of the compact disc 4 is seated on the mounting stud 3 in the cartridge 1, which stud comprises stud portions 6 and gaps 7. To place the anti-theft device in position, the unit comprising the lock gear 10, lock spring 9 and perforate plate 8 is placed over the free end of mounting stud 3 on cartridge 1. At that time, the stop pin 30 engages one end of the slot 19, tabs 18 do not engage recesses 20 and each one of the tabs 17 is located behind one of the teeth 14 on the lock gear 10. In the process of so assembling the anti-theft device with the compact disc, the teeth 14 on the lock gear 10 move through the gaps 7 between stud fingers 6 of the mounting stud 3 so that the lock gear comes to lie axially behind the ends of the fingers 6 of the mounting stud 3. Also, the inwardly projecting tabs 17 of the lock spring 9 move into corresponding gaps 7 so that the spring is prevented from rotating. Then, the perforate plate 8 and lock gear 10 are rotated together relative to the mounting stud 3 and lock spring 9 into the locked position at which the stop pin 30 abuts the other end of slot 19, tabs 18 enter recesses 20 and teeth 14 on the lock gear 10 reach positions behind the ends of the fingers 6 on the mounting stud 3. In the locked position, the anti-theft device cannot be withdrawn axially from the cartridge 1 and compact disc 4. Such withdrawal will not be possible unless release tool 12 has been applied such that the pins 25 move through the holes 24 into recesses 20 so as to push elongated tabs 18 from their recesses 20 towards lock gear 10. Release tool 12 may then be rotated until the stop pin 30 engages the other end of the slot 19. The teeth 14 of the lock gear 10 will then be aligned with corresponding gaps 7 in the mounting stud 3 so that the entire anti-theft device may be withdrawn from the mounting stud 3.

Advantageously, the entire anti-theft device has axial dimensions so small that the conventional cartridges 1 available for compact discs 4 will readily accommodate it.

Anti-theft devices of the aforesaid type will, as described, be attached by authorized sales personnel to all of the compact discs and their cartridges which are accessible to customers at a point of sale. Also, as described below, authorized personnel such as a cash register attendant may remove the inventive anti-theft device by using the aforesaid release tool. As each exit which does not have a cash register installed thereat is provided with one of the aforesaid monitoring zones including means responsive to the magnetic strips, the compact discs cannot be stolen any longer.

Also, advantageously, once removed from compact discs that were paid for, the inventive anti-theft devices may be reused, i.e., they may be newly attached to other compact discs to be offered for sale.

I claim:

1. An anti-theft device for restricting unauthorized removal of an article, such as a recording medium, a compact digital audio disc or the like, from a cartridge having a mounting stud engaging a central opening in the article when said article is in position in the cartridge, said device comprising a perforate plate having a plurality of holes extending therethrough, means for locking the plate to the mounting stud of said cartridge when said article is in position between said perforate plate and cartridge, and unlocking means having thereon pins for engaging said through-holes in the perforate plate from the side thereof opposite the article to actuate said locking means for releasing the plate and article from the mounting stud.

2. An anti-theft device according to claim 1, wherein (a) said locking means comprising a lock gear having at least one tooth-like projection along the periphery thereof, and a ring-like lock spring located between said lock gear and said perforate plate, said lock spring having outwardly extending first projections arranged in accordance with a pre-selected code and inwardly extending second projections adapted to be positioned adjacent said mounting stud to prevent rotation of said spring, (b) said perforate plate has a plurality of recesses in the surface thereof adjacent said lock spring and positioned in accordance with said pre-selected code to allow said outwardly extending first projections to engage a corresponding recess when said plate is in a first, locked, position relative to said lock spring, (c) said at least one tooth-like projection on said lock gear extends towards one of said inwardly extending second projections on said lock spring when in a second unlocked, position relative to said lock spring at which said first projections are not in said corresponding recesses, and (d) each said recess has therein a through-hole extending through said plate and adapted to receive a pin of said unlocking means introduced therein to urge said first projections from said recesses so that said plate and lock gear may be rotated relative to said lock spring from the first locked position to the second unlocked position at which said lock gear is positioned in the axially extending interior of said mounting stud, said interior being defined by stud portions separated by gaps and each having a radially inwardly extending end portion, and is thereafter rotatable together with said plate relative to said mounting stud and lock spring into the first locked position at which said at least one tooth-like projection on said lock gear is located behind a said end of a said stud portion.

3. An anti-theft device according to claim 2, wherein said lock spring comprises a circular ring from which said second projections extend inwardly.

4. An anti-theft device according to claim 3, wherein first projections extend outwardly from said circular ring.

5. An anti-theft device according to claim 2, wherein said lock gear has a plurality of tooth-like projections distributed around the periphery thereof.

6. An anti-theft device according to claim 2, further comprising means for limiting the range of rotation of said plate relative to said lock spring.

7. An anti-theft device according to claim 6, wherein said rotation limiting means comprises a slot in said lock spring and a stop pin attached to said perforate plate to engage one end of said slot in said first locked position and to engage the other end of said slot in said second unlocked position.

8. An anti-theft device according to claim 1, wherein said unlocking means comprises a knob, having on one side thereof a surface from which extend said pins and having a central shaft adapted to be introduced in an opening provided in said plate.

9. An anti-theft device according to claim 8, wherein said perforate plate and said unlocking means contain indicia to indicate the positions of said pins relative to said through-holes.

10. An anti-theft device according to claim 2, wherein said inwardly extending second projections on said lock spring are bent resiliently from the plane of the lock spring towards said lock gear, and said outwardly extending first projections are bent resiliently towards said perforate plate.

11. An anti-theft device according to claim 2, wherein said lock gear is beveled on its side facing away from said perforate plate to facilitate introduction of said gear into said mounting stud.

12. An anti-theft device according to claim 1, further comprising means for triggering the generation of an alarm signal in response to movement of said device through a monitoring zone.

13. An anti-theft device according to claim 12, wherein said means for triggering the generation of an alarm signal comprises at least one high permeability magnetic strip affixed to the surface of said perforate plate facing said lock gear.

14. An anti-theft device as in claim 13, wherein said perforate plate has affixed thereto two magnetic strips arranged in a perpendicular relationship.

15. An anti-theft device according to claim 1, wherein the peripheral edge of said perforate plate has formed therealong a flange (27) extending towards said cartridge.

16. A device adapted to be releaseably attached to a base member having an aperture with a plurality of radially inwardly directed spaced fingers about its periphery, said device comprising:

a locking means including a plate larger than the aperture having a first surface, a post fixed at one end to and projecting from said first surface and adapted to be received in said aperture, and a lock member fixed to the opposite end of said post having a plurality of projections adapted to pass between said fingers;

a lock spring disposed around said post between said lock member and said first surface, said lock spring including a plurality of radially inwardly projecting locating tabs located and spaced to be received between the fingers and a plurality of radially outwardly projecting locking tabs, said spring being resiliently compressed between said first surface and said lock member with said locking tabs biased against said first surface; and means for restricting rotational movement of said lock member relative to said lock spring between an unlocked position at which said locating tabs are aligned with said projections to allow said projections to be moved past the fingers, and a locked position at which the projections are out of alignment with the locating tabs and are positioned below the fingers to preclude withdrawing the lock member from the aperture;

said plate having recesses along said first surface spaced to receive the ends of said locking tabs when said plate and spring are in said locked position to prevent relative rotation to said unlocked position, and having through openings from its side opposite said first surface and communicating with said recesses adapted to receive pins to lift said locking tabs from said recesses and thereby allow rotation of said plate relative to said spring to said unlocked position.

* * * * *